US008632021B2

(12) United States Patent
Li et al.

(10) Patent No.: US 8,632,021 B2
(45) Date of Patent: Jan. 21, 2014

(54) PUMP HEAD ASSEMBLY AND PRESSURE WASHER WITH SUCH PUMP HEAD ASSEMBLY

(75) Inventors: Jiang Li, Changzhou (CN); Bo Wang, Changzhou (CN); Yingtang Ling, Changzhou (CN)

(73) Assignee: Yin Chen, Changzhou (CN)

( * ) Notice: Subject to any disclaimer, the term of this patent is extended or adjusted under 35 U.S.C. 154(b) by 1013 days.

(21) Appl. No.: 12/702,328

(22) Filed: Feb. 9, 2010

(65) Prior Publication Data

US 2010/0206964 A1 Aug. 19, 2010

(30) Foreign Application Priority Data

Feb. 16, 2009 (CN) ..... 2009 1 0024800

(51) Int. Cl.

| | |
|---|---|
| ***A62C 5/02*** | (2006.01) |
| ***A62C 31/00*** | (2006.01) |
| ***B05B 9/00*** | (2006.01) |
| ***F23D 11/40*** | (2006.01) |

(52) U.S. Cl.

USPC ..... 239/312; 239/310; 239/398; 239/418; 239/419; 239/433

(58) Field of Classification Search

USPC ..... 239/310, 312, 317, 398, 407, 418, 419, 239/427, 427.3, 433, 434, 571

See application file for complete search history.

(56) References Cited

U.S. PATENT DOCUMENTS

| | | | | |
|---|---|---|---|---|
| 4,341,350 | A * | 7/1982 | Wemmer | 239/312 |
| 4,480,967 | A * | 11/1984 | Schulze | 417/368 |
| 5,960,887 | A * | 10/1999 | Crabtree | 169/15 |
| 7,178,740 | B2 * | 2/2007 | Williams | 239/10 |
| 7,854,398 | B2 * | 12/2010 | Hahn et al. | 239/444 |

* cited by examiner

*Primary Examiner* — Ryan Reis

(57) ABSTRACT

The patent application relates to a pump head assembly. The pump head assembly includes a pump head which at least has a water inlet and a first water outlet between which a pressurizing unit is provided, and the pump head further includes a second water outlet, a throttle orifice is provided between the water inlet and the second water outlet, the throttle orifice is provided with a water outlet end and a water inlet end, the throttle orifice is provide with a liquid suction port, and a one way valve is provided on the liquid suction port. The pump head assembly realizes cleaning liquid suction by self-pressure of tap water, which lowers energy consumption, and effectively and reasonably saves energy sources.

17 Claims, 5 Drawing Sheets

K-K

PUMP HEAD ASSEMBLY AND PRESSURE WASHER WITH SUCH PUMP HEAD ASSEMBLY

TECHNICAL FIELD

This patent application relates to a pump head assembly for a pressure washer. This patent application also relates to a pressure washer with a pump head assembly.

DESCRIPTION OF THE RELATED ART

Electric pressure washer has brought great comfort to our life. It is used for cleaning the automobile, cleaning the glass door and window, cleaning the pave of the house and so on. It is high sufficient, safe and convenient for use. The electric pressure washer usually includes a motor, a high pressure pump, a spray gun and a control unit. The electric pressure washer in the prior art realizes the cleaning compound intake function via the motor power. Water will flow through a throttle orifice which is arranged for automatic intake of the cleaning compound whether the pressure washer sucking the cleaning compound or not. It normally needs 100w power. If the pressure does not need to suck the cleaning compound, it will waste power and thus increase the cost. When there is something wrong with the pressure, it is inconvenient to stop the machine. And when the operator needs spraying cleaning compound or low pressure cleaning, the spray head needs to be changed, thus it is complicated for the operator.

SUMMARY

According to one aspect of the patent application, a pump head assembly for a pressure washer, including: a fluid inlet; a first water outlet; a pressurizing unit disposed between the first water outlet and the fluid inlet; the pump head assembly includes a separate second water outlet, and a throttle orifice disposed between the fluid inlet and the second water outlet; and wherein a liquid suction port for cleaning compound flowing through is disposed at an outlet end of the throttle orifice.

In one embodiment, a one way valve is disposed in the liquid suction port for controlling the cleaning compound intake.

In one embodiment, the throttle orifice is in the shape of a funnel that has a small-mouth and a large-mouth.

In one embodiment, the outlet end of the throttle orifice is the small-mouth of the funnel.

In one embodiment, a liquid intake shifter is disposed between the fluid inlet and the second water outlet, the liquid intake shifter is shiftable between a first position that the fluid inlet and the second water outlet are connected through the throttle orifice, and a second position that the fluid inlet and the second water outlet are connected through a passage independent from the throttle orifice.

In one embodiment, the liquid intake shifter includes a liquid intake ball valve which is disposed between the fluid inlet and the throttle orifice.

In one embodiment, the passage of the liquid intake shifter is substantially parallel to a passage formed by the throttle orifice.

In one embodiment, a seal ring is equipped with the liquid intake ball valve.

In one embodiment, the water outlet pressure at the second water outlet is substantially the same as the fluid inlet pressure.

In one embodiment, the pressure of the fluid at the first outlet is greater than the pressure of the fluid at the second outlet.

In one embodiment, an overflow valve is disposed between the fluid inlet and the first water outlet such that water will flow back to the fluid inlet when the water outlet pressure is above a predetermined value.

In one embodiment, the first water outlet extends along a first axis, the second water outlet extends along a second axis, the first axis is parallel to the second axis. More particularly, the liquid suction port extends along an axis that is perpendicular to the second axis.

According to another aspect of the present patent application, a pressure washer including: a pump head assembly; a spray gun having a first inlet and a second inlet; the pump head assembly includes a fluid inlet; a first water outlet connected with the first inlet of the spray gun; a pressurizing unit disposed between the first water outlet and the fluid inlet; the pump head assembly includes a separate second water outlet connected with the second inlet of the spray gun, and a throttle orifice disposed between the fluid inlet and the second water outlet; and a liquid suction port for cleaning compound flowing through is disposed at an outlet end of the throttle orifice.

In one embodiment, a one way valve is disposed in the liquid suction port for controlling the cleaning compound intake.

In one embodiment, the throttle orifice is in the shape of a funnel that has a small-mouth and a large-mouth. More particularly, the outlet end of the throttle orifice is the small-mouth of the funnel.

In one embodiment, a liquid intake shifter is disposed between the fluid inlet and the second water outlet, the liquid intake shifter is shiftable between a first position that the fluid inlet and the second water outlet are connected through the throttle orifice, and a second position that the fluid inlet and the second water outlet are connected through a passage independent from the throttle orifice. Preferably, the liquid intake shifter includes a liquid intake ball valve which is disposed between the fluid inlet and the throttle orifice.

In one embodiment, the passage of the liquid intake shifter is substantially parallel to a passage formed by the throttle orifice.

Compared with the prior art, the pump head assembly realizes cleaning liquid suction by self-pressure of tap water, which lowers energy consumption, and effectively and reasonably saves energy sources.

During the high pressure washing process, the pressure washer needs less motor power than the ordinary pressure washer in order to output the same quantity of water, thus it reduces the product cost.

The pressure washer should be operated to realize high pressure washing and low pressure cleaning at the same time by actuating the high pressure washing switch and the low pressure cleaning switch simultaneously.

The spray gun of the pressure washer is connected with the pump head assembly by soft tube which makes the spray gun more comfortable for the operator.

REFERENCE NUMERALS IN THE DRAWINGS

Figure 1:
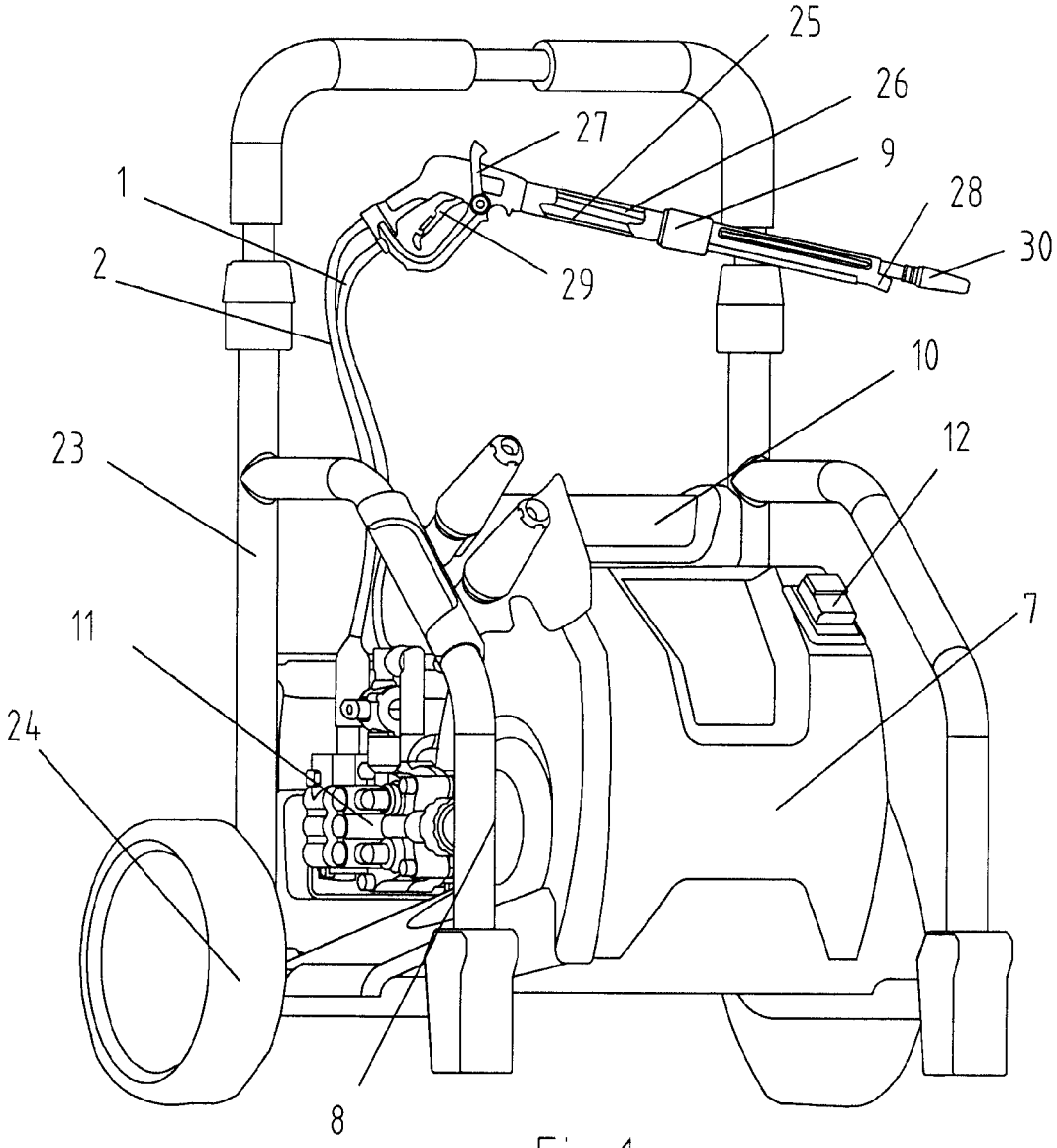
FIG. 1 is an illustrative view of a pressure washer according to an embodiment of the patent application.

1. motor
3. pressurizing unit
5. spray gun
7. cleaning compound container
9. pump head assembly
11. switch
13. micro movement switch assembly
15. pump head
17. fluid inlet
19. first water outlet
21. second water outlet
23. throttle orifice
25. output end
27. intake end
29. liquid suction port
31. one way valve
32. frame
33. wheel
35. liquid intake ball valve
37. liquid intake shifter
39. overflow valve assembly
41. valve core
43. spring
45. lever
47. micro movement switch button
49. micro movement switch
51. liquid suction valve connector
53. low pressure tube
55. high pressure tube
57. switch ball valve
59. low pressure soft tube
61. low pressure washing head
63. high pressure trigger
65. high pressure soft tube
67. high pressure washing head
69. protective cover
71. liquid intake button

DETAILED DESCRIPTION

Referring to FIG. 1, it shows a pressure washer which has a pump head assembly. The pressure washer includes a motor 1, a pressurizing unit 3, a spray gun 5, a cleaning compound container 7, a pump head assembly 9, a switch 11 for controlling the motor, and a micro-movement switch assembly 13 for preventing the motor 1 from overload.

The pressure washer is disposed on a frame 32. A pair of wheels 33 is disposed on the bottom of the frame 32 in order that the operator can move the pressure washer when cleaning a window.

The pump head assembly 9 includes a pump head 15. The pump head 15 has a fluid inlet 17, a first water outlet 19. The fluid inlet 17 is connected with tap water.

The pressurizing unit 3 is disposed between the first water outlet 19 and the fluid inlet 17. The pressurizing unit 3 drives the pump head assembly 9 to output high pressure water. The pressurizing unit 3 in the present embodiment is a rod-piston type pressurizing unit 3.

Figure 2:
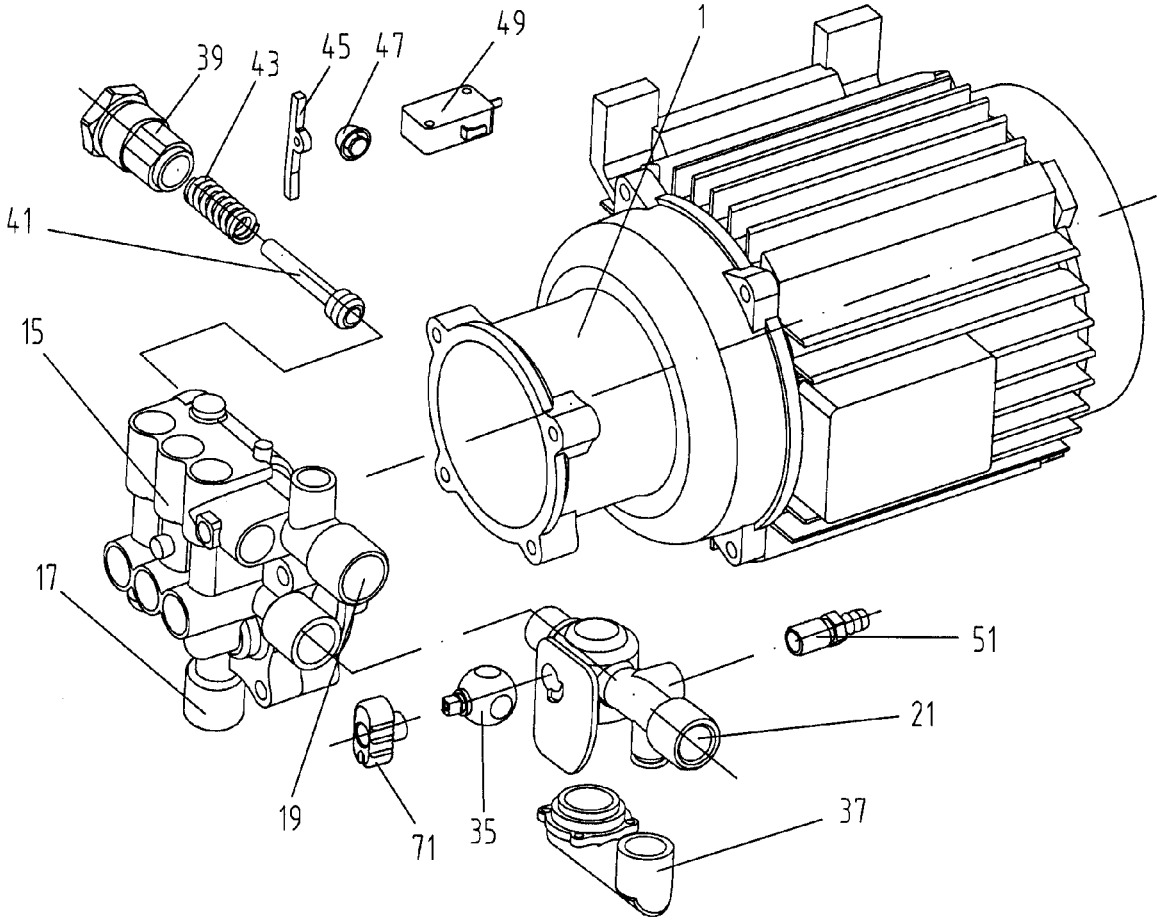
FIG. 2 is an explosive view of a pressure washer according to an embodiment of the patent application.
Figure 3:
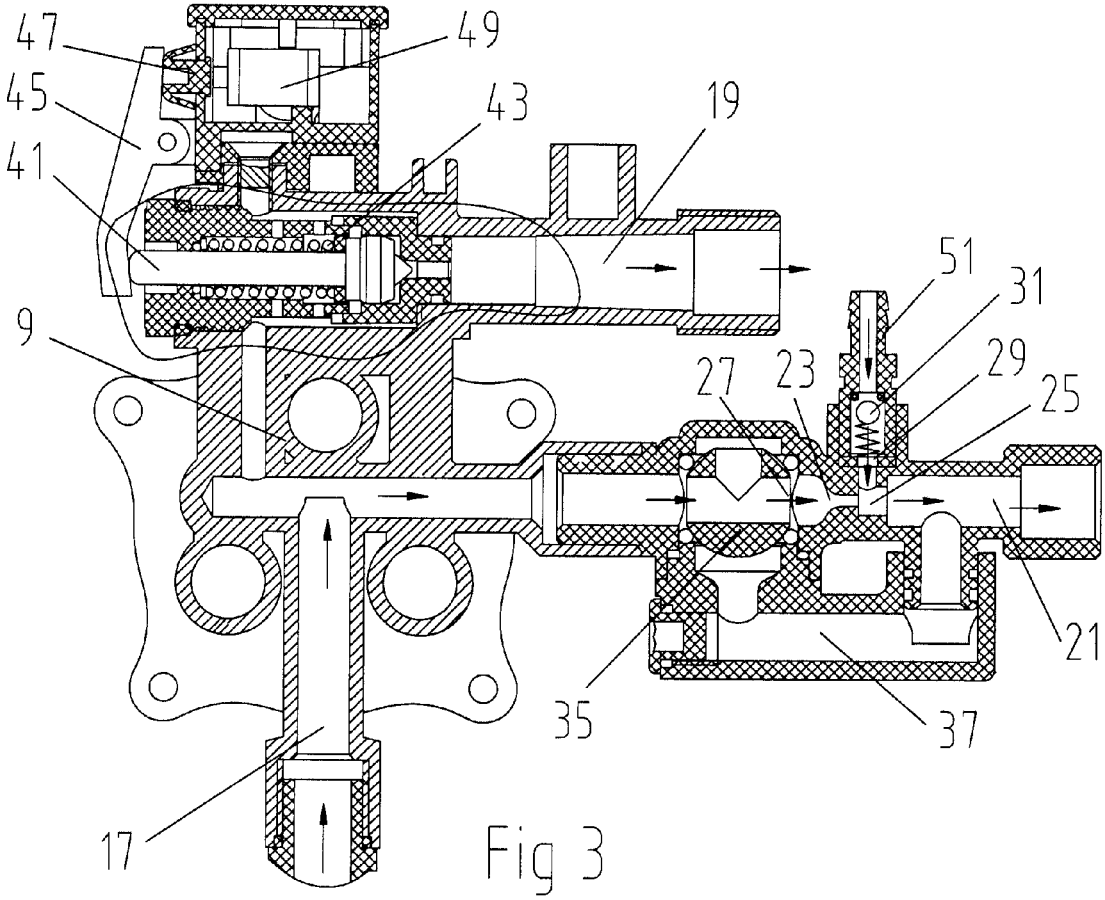
FIG. 3 is a sectional view of a pump head assembly, wherein it is in the status of cleaning compound intake.
Figure 4:
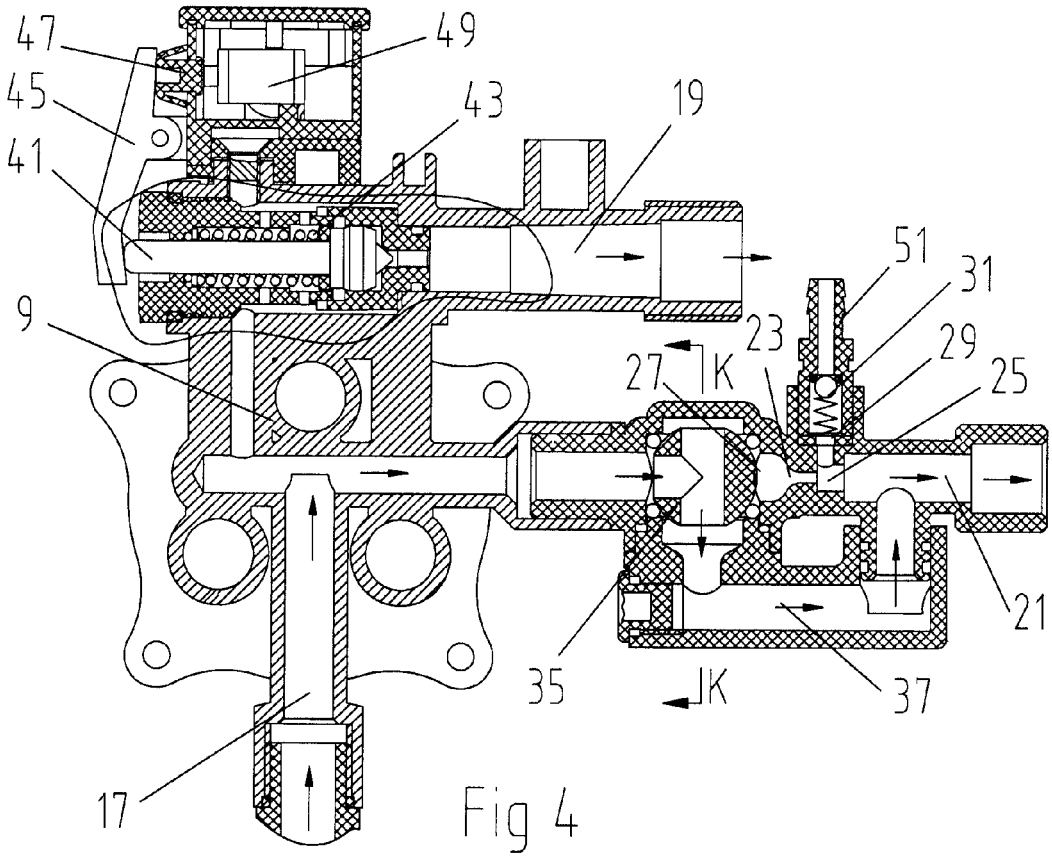
FIG. 4 is a sectional view of a pump head assembly, wherein it is in the status of low pressure washing.

Also referring to FIG. 2, FIG. 3 and FIG. 4, the pump head 15 includes a second water outlet 21. A throttle orifice 23 is disposed between the second water outlet 21 and the fluid inlet 17. The throttle orifice 23 has an output end 25 and an intake end 27. A liquid suction port 29 for cleaning compound flowing through is disposed at the output end 25 of the throttle orifice 23. The first water outlet 19 extends along a first axis, the second water outlet 21 extends along a second axis, the first axis is parallel to the second axis. More particularly, the liquid suction port 29 extends along an axis that is perpendicular to the second axis.

A liquid intake shifter 37 is disposed between the fluid inlet 17 and the second water outlet 21. The liquid intake shifter 37 is shiftable between a first position that the fluid inlet 17 and the second water outlet 21 are connected through the throttle orifice 23, and a second position that the fluid inlet 17 and the second water outlet 21 are connected through a passage independent from the throttle orifice 23. The liquid intake shifter 37 includes a liquid intake ball valve 35 which is disposed between the fluid inlet 17 and the throttle orifice 23. In this embodiment, the liquid intake ball valve 35 is disposed at the inlet end 27 of the throttle orifice 23. The passage of the liquid intake shifter 37 is substantially parallel to a passage formed by the throttle orifice 23. The liquid intake ball valve 35 is rotatable about the second water outlet 21 such that the fluid inlet 17 is selectively got connection with the inlet end 27 of the throttle orifice 23 or the outlet end 25 of the throttle orifice 23.

The throttle orifice 23 is in the shape of a funnel that has a small-mouth and a large-mouth. The outlet end 25 of the throttle orifice 23 is the small-mouth of the funnel. Thus the cleaning compound will be automatically sucked from the liquid suction port 29 via the pressure of tap water. It realizes cleaning liquid suction by self-pressure of tap water, which lowers energy consumption, and effectively and reasonably saves energy sources. A seal ring is equipped with the liquid intake ball valve 35.

The water outlet pressure at the second water outlet 21 is substantially the same as the fluid inlet pressure at the fluid inlet 17.

The pressure of the fluid at the first water outlet 19 is greater than the pressure of the fluid at the second water outlet 21.

An overflow valve 39 is disposed between the fluid inlet 17 and the first water outlet 19 such that water will flow back to the fluid inlet 17 when the water outlet pressure of the first water outlet 19 is above a predetermined value. The overflow valve 39 is connected with a micro movement switch assembly 13. The overflow valve 39 is mounted below the pump head 15. One end of the overflow valve 39 is fluid with the first water outlet 19, while the other end of the overflow valve 39 is fluid with the fluid inlet 17. The overflow valve 39 includes a valve core 41 and a spring 43 which is mounted around the valve core 41. The spring 43 is prepressed such that it provides the valve core 41 a predetermined pressure.

The micro movement switch assembly 13 includes a lever 45, a micro movement switch button 47 and a micro movement switch 49. One end of the lever 45 is contacted with the bottom of the valve core 41, the other end of the lever 45 is contacted with the micro movement switch button 47, such that, the lever 45 and the micro movement switch button 47 and the bottom of the valve core 41 are connected according to a lever theory. When the motor 1 is overload, the water pressure of the first water outlet 19 increases larger that the prepress pressure of the spring 43, the spring 43 will push the valve core 41 moving to open the overflow valve 39. The high pressure water in the first water outlet 19 flows back to the fluid inlet 17 through the overflow valve 39. And at the same time, the valve core 41 presses the lever 45 to rotate the lever 45, and the lever 45 actuate the micro movement switch button 47 to cut off the micro movement switch 49, the motor 1 stops. Thereby, the motor 1 will not be destroyed.

A liquid suction valve connector 51 is disposed at the liquid suction port 29. A one way valve 31 is disposed in the liquid suction port 29 for controlling the cleaning compound intake. The liquid suction valve connector 51 is connected with the cleaning compound container 7 via soft tube. When the liquid intake ball valve 35 is selected to be connected with the inlet end 27 of the throttle orifice 23, the pressure from the tap water will automatically suck the cleaning compound from the cleaning compound container 7 into the second water outlet 21 in order to realize low pressure liquid intake.

The first water outlet 19 extends along a first axis. The second water outlet 21 extends along a second axis. The first axis is parallel to the second axis. More particularly, the liquid suction port 29 extends along an axis that is perpendicular to the second axis.

A low pressure tube 53 and a high pressure tube 55 are disposed on the spray gun 5. A switch ball valve 57 is mounted in the low pressure tube 53. A low pressure soft tube 59 is connected with a water inlet end of the low pressure tube 53. A low pressure washing head 61 is connected with a water outlet end of the low pressure tube 53. The switch ball valve 57 is operable to control the on/off of the low pressure tube 53.

A high pressure trigger 63 is disposed on the high pressure tube 55. A high pressure soft tube 65 is connected with a water inlet end of the high pressure tube 55. A high pressure washing head 67 is connected with a water outlet end of the high pressure tube 55. The high pressure trigger 63 is operable to control the on/off of the high pressure tube 65.

The low pressure soft tube 59 and the high pressure soft tube 65 are formed by integral soft tube such that the soft tube is hard to be folded, tap water in the low pressure soft tube 59 will flow smoothly. Protective cover 69 are respectively arranged at the end of the low pressure soft tube 59 and the high pressure soft tube 65. Thereby the low pressure soft tube 59 and the high pressure soft tube 65 are hard to be torn. The soft tube will not be folded such that the flow quantity and pressure of the pressure washer will be maintained.

FIG. 3 shows a sectional view of the pump head assembly being in the status of cleaning compound intake. The operator adjusts the liquid intake ball valve 35 that the fluid inlet 17 is fluid with the throttle orifice 23 and disconnected with the liquid intake shifter 37, thus the low pressure tap water could automatically suck the cleaning compound and output water. That means the second water outlet 21 will flow water with cleaning compound.

FIG. 4 shows a sectional view of a pump head assembly being in the status of low pressure washing. The operator adjusts the liquid intake ball valve 35 that the fluid inlet 17 is fluid with the liquid intake shifter 37 and disconnected with the throttle orifice 23. The tap water from the fluid inlet 17 will flow out to wash the things to be clean.

Figure 5:
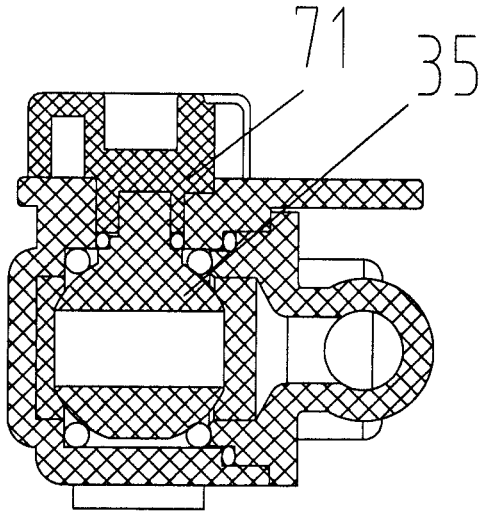
FIG. 5 is a sectional view of FIG. 4 along line K-K.

FIG. 5 is a sectional view of FIG.4 along line K-K. A liquid intake switch button 71 is connected with the liquid intake ball valve 35. The liquid intake switch button 71 is rotated by the operator and rotates the liquid intake ball valve 35, thus the pressure washer smoothly be shifted from a liquid intake status and a low pressure washing status.

The pressure washer is operated by the following steps.

Firstly, the high pressure soft tube 65 is inserted into the end of the high pressure tube 55. Lock the end portion of the high pressure soft tube 65 by a pin. The low pressure soft tube 59 is inserted into the end of the low pressure tube 53 and locked.

Put the cleaning compound into the cleaning compound container 7. Connect the tap water tube with the fluid inlet 17.

Connect the power cord to the power source.

Adjust the liquid intake ball valve 35 to the liquid intake status. Open the low pressure switch ball valve 57. The tap water flows from the fluid inlet 17 into the liquid intake ball valve 35 at certain pressure and flow quantity. And then the tap water is sprayed out through the throttle orifice 23. Because of the spray function, the liquid suction port 29 will form vacuum space, the cleaning compound will move against the one way valve 31 and flow into the second water outlet 21 to mix with the tap water. Mixture of the cleaning compound and the tap water will move through the low pressure soft tube 59, the low pressure tube 53 and the switch ball valve 57 and sprayed out from the low pressure washing head 61 to spray cleaning compound to the things to be cleaned.

And then turn on the high pressure trigger 63 of the spray gun 5 and press the power switch to actuate the pressurizing unit 3 such that the high pressure tube 55 will spray high pressure water. The tap water flows through the first water outlet 19, the high pressure soft tube 65, the high pressure tube 55 and spray out from the high pressure washing head 67 to high pressure clean the things to be cleaned.

Compared with the prior art, when the pressure washer is operated in the high pressure washing status, because there is no throttle orifice in the first water outlet 19 and part of resistance is reduced, the same quantity of water will cost less energy. Power of the motor 1 will be cost less, product cost is reduced and the energy is saved.

At the same time, the liquid intake ball valve 35 can be adjusted by rotating 90 degrees to be a washing status. The tap water flows from the fluid inlet 17 into the liquid intake ball valve 35, then flows through the liquid intake shifter 37, the second water outlet 21, the low pressure soft tube 59, the low pressure tube 53 and the switch ball valve 57, sprays out from the low pressure washing head 61 to clean the things been sprayed.

According to some tests, the low pressure washing flow quantity of a one tube pressure washer in the prior art is 180-200 L/h, while the low pressure washing flow quantity of the present pressure washer which has the same tube diameter is 560-600 L/h. It shows that the low pressure washing flow quantity of the present pressure washer is more than three times of that in the prior art.

Of course, when the high pressure trigger 63 is opened, the switch ball valve 57 is also opened. The pressure washer will clean the dirt which was sprayed by the high pressure water quickly. Thus the pressure washer can complete high pressure spray and low pressure clean at one time, the cleaning efficiency is improved.

In the present patent application, a channel can be connected directly between the fluid inlet 17 and the second water outlet 21. The low pressure liquid intake device can be directly arranged on the channel to realize liquid intake and low pressure cleaning between the fluid inlet 17 and the second water outlet 21.

We claim:

1. A pump head assembly for a pressure washer, comprising:

a fluid inlet;

a first water outlet;

a pressurizing unit disposed between the first water outlet and the fluid inlet;

wherein the pump head assembly comprises a separate second water outlet, and a throttle orifice disposed between the fluid inlet and the second water outlet;

wherein the pressurizing unit being used for driving the pump head assembly to output high pressure water, so that the pressure of the fluid at the first outlet being greater than the pressure of the fluid at the second outlet; and wherein a liquid suction port for cleaning compound flowing through is disposed at an outlet end of the throttle orifice;

wherein a liquid intake shifter is disposed between the fluid inlet and the second water outlet, the liquid intake shifter being shiftable between a first position that the fluid inlet and the second water outlet connected through the liquid intake shifter and the throttle orifice, and a second position that the fluid inlet and the second water outlet connected through the liquid intake shifter and a passage independent from the throttle orifice.

2. The pump head assembly of claim 1, wherein a one way valve is disposed in the liquid suction port for controlling the cleaning compound intake.

3. The pump head assembly of claim 1, wherein the throttle orifice is in the shape of a funnel that has a small-mouth and a large-mouth.

4. The pump head assembly of claim 3, wherein the outlet end of the throttle orifice is the small-mouth of the funnel.

5. The pump head assembly of claim 1, wherein the liquid intake shifter comprises a liquid intake ball valve which is disposed between the fluid inlet and the throttle orifice.

6. The pump head assembly of claim 1, wherein the passage of the liquid intake shifter is substantially parallel to a passage formed by the throttle orifice.

7. The pump head assembly of claim 5, wherein a seal ring is equipped with the liquid intake ball valve.

8. The pump head assembly of claim 1, wherein the water outlet pressure at the second water outlet is substantially the same as the fluid inlet pressure.

9. The pump head assembly of claim 1, wherein an overflow valve is disposed between the fluid inlet and the first water outlet so that water will flow back to the fluid inlet when the water outlet pressure is above a predetermined value.

10. The pump head assembly of claim 1, wherein the first water outlet extends along a first axis, the second water outlet extends along a second axis, the first axis is parallel to the second axis.

11. The pump head assembly of claim 10, wherein the liquid suction port extends along an axis that is perpendicular to the second axis.

12. A pressure washer comprising:

a pump head assembly;

spray gun with a first inlet and a second inlet;

the pump head assembly comprises:

a fluid inlet;

a first water outlet connected with the first inlet of the spray gun;

a pressurizing unit disposed between the first water outlet and the fluid inlet;

wherein the pump head assembly comprises a separate second water outlet connected with the second inlet of the spray gun, and a throttle orifice disposed between the fluid inlet and the second water outlet;

wherein the pressurizing unit being used for driving the pump head assembly to output high pressure water, so that the pressure of the fluid at the first water outlet being greater than the pressure of the fluid at the second water outlet; and wherein a liquid suction port for cleaning compound flowing through is disposed at an outlet end of the throttle orifice;

wherein a liquid intake shifter is disposed between the fluid inlet and the second water outlet, the liquid intake shifter being shiftable between a first position that the fluid inlet and the second water outlet connected through the liquid intake shifter and the throttle orifice, and a second position that the fluid inlet and the second water outlet connected through the liquid intake shifter and a passage independent from the throttle orifice.

13. The pressure washer of claim 12, wherein a one way valve is disposed in the liquid suction port for controlling the cleaning compound intake.

14. The pressure washer of claim 12, wherein the throttle orifice is in the shape of a funnel that has a small-mouth and a large-mouth.

15. The pressure washer of claim 14, wherein the outlet end of the throttle orifice is the small-mouth of the funnel.

16. The pressure washer of claim 12, wherein the liquid intake shifter comprises a liquid intake ball valve which is disposed between the fluid inlet and the throttle orifice.

17. The pressure washer of claim 12, wherein the passage of the liquid intake shifter is substantially parallel to a passage formed by the throttle orifice.

* * * * *